US005465026A

United States Patent [19]

Roussel et al.

[11] Patent Number: 5,465,026

[45] Date of Patent: Nov. 7, 1995

[54] DEFLECTION YOKE WITH A CORE EXTENSION

[75] Inventors: Bruno Roussel; Alain Dumesnil, both of Genlis, France

[73] Assignee: Videocolor, Paris La Defense, France

[21] Appl. No.: 41,390

[22] Filed: Apr. 1, 1993

[30] Foreign Application Priority Data

Apr. 7, 1992 [FR] France ..... 92 04248

[51] Int. Cl.[6] ..... H01J 29/76

[52] U.S. Cl. ..... 313/440; 313/430; 313/431; 313/442; 335/212; 335/298

[58] Field of Search ..... 313/440, 412, 313/413, 421, 428, 430, 431, 442; 335/210, 211, 212, 298

[56] References Cited

U.S. PATENT DOCUMENTS

| | | | |
|---|---|---|---|
| 2,646,522 | 7/1953 | Shaw et al. | 313/428 |
| 2,821,671 | 1/1958 | Kratz et al. | 313/440 |
| 3,189,775 | 6/1965 | Fyler | 335/212 |
| 3,247,426 | 4/1966 | Havn | 335/212 |
| 3,711,802 | 1/1973 | Torsch . | |
| 3,778,669 | 12/1973 | Cooper et al. . | |
| 4,100,518 | 7/1978 | Smith . | |
| 4,866,336 | 9/1989 | Sluyterman | 313/440 |
| 5,306,982 | 4/1994 | Maillot et al. | 313/440 |

FOREIGN PATENT DOCUMENTS

| | | | |
|---|---|---|---|
| 405109370 | 4/1993 | Japan | 313/440 |

*Primary Examiner*—Sandra L. O'Shea
*Assistant Examiner*—Vip Patel
*Attorney, Agent, or Firm*—Joseph S. Tripoli; Joseph J. Laks; Sammy S. Henig

[57] ABSTRACT

A deflection yoke includes a first core portion and a core extension portion. The core extension portion is located in the rear of the yoke closer to the beam entrance region. To adjust the yoke for the particular cathode ray tube on which it is mounted, the position of the yoke is adjusted for obtaining acceptable image geometry. Then, the core extension is moved with respect to the first core portion in a direction perpendicular to the longitudinal axis of the tube to obtain convergence symmetry while the position of the first core portion remains the same. In this way, convergence symmetry adjustment is accomplished separately from image geometry adjustment.

9 Claims, 3 Drawing Sheets

DEFLECTION YOKE WITH A CORE EXTENSION

This invention relates to an arrangement of a deflection yoke mounted in a cathode ray tube (CRT).

In CRT's using a coplanar three-beam electron gun corresponding to the three primary colors red, green and blue, a deflection yoke deflects the beams so as to scan the entire surface of the tube screen to generate images. A "self-converging" yoke produces astigmatic horizontal and vertical deflection fields to provide the convergence of the beams. The required deflection field is formed by a pincushion horizontal deflection field and a barrel vertical deflection field.

Typically, the relative positions among the horizontal deflection coil, the vertical deflection coil and a magnetic core of the deflection yoke are fixed with respect to one another during the making of the yoke and do not change during the mounting process of the yoke on a neck of the CRT. The core has a form of a hollowed annular magnetic material with high permeability. During the mounting of the yoke on the neck of the cathode-ray tube, the position of the yoke is adjusted in a manner to reduce image impurity and asymmetry of the electron beams with respect to the deflection fields axes. Typically, such positioning or mounting of the yoke on the CRT includes the steps of aligning the deflection yoke along the longitudinal axis or Z-axis of the CRT such that color purity is obtained. Then, the horizontal and vertical deflection fields are aligned with the horizontal or major axis X and with the vertical or minor axis Y of the CRT screen by rotating the deflection yoke about the longitudinal Z-axis. Then, convergence adjustment is performed to adjust asymmetry between the axes of the deflection fields and the electron beams by rotation of the deflection yoke in the horizontal, X-Z, and vertical, Y-Z, planes or by translation along the vertical Y-axis and horizontal X-axis.

The asymmetry of the axes of the deflection field is adjusted to adjust convergence for maintaining equal separation and in the same sense between vertical red and blue lines at 3 and 9 o'clock hour points on the CRT screen. Same sense separation means that the vertical blue line is either located in both the 3 and 9 o'clock hour points to the left of the vertical red line or located in both such hour points to the right of it. Also, asymmetry is adjusted for maintaining equal separation and in the same sense between vertical blue and red lines in both the 12 and 6 o'clock hour points. In a conventional yoke the operation of adjusting the field axes asymmetry to provide convergence is referred to by the term YAMMING.

This procedure may involve several drawbacks. For example, the step of asymmetry adjustment by the rotation or translation of the deflection yoke suggests that, at least in the front section of the yoke, sufficient mechanical clearance has to be provided for obtaining position adjustment variations within a given range. Disadvantageously, the greater is the clearance, the less becomes the deflection sensitivity of the deflection yoke.

Moreover, with a CRT having a screen with a large radius of curvature, in which the screen is almost flat, the aforementioned step of asymmetry adjustment could cause considerable geometrical distortions of the image. It may be desirable to align the deflection yoke on the neck of the CRT such that deflection sensitivity or power requirement of the deflection yoke is not degraded and without significantly increasing geometrical distortions.

It is customary to consider the deflection field as divided into three successive regions along the Z-axis. The rear zone, that is the closest to the electron gun, affects the coma or difference in size of the green image with respect to an average of the blue and the red images more than the field in the other two zones that are further away from the gun. The middle zone of the deflection yoke affects the astigmatism of the deflection fields to provide convergence of the red and blue electron beams. The front zone is located closest to the tube screen and affects geometry distortion of the image more than the other two zones.

In a deflection yoke, embodying a feature of the invention, the fields axes asymmetry adjustment with respect to the electron beams is accomplished by means of a ring of magnetic material placed around the medium and rear zones of saddle shaped deflection coils. Translations of the ring in directions parallel to the X-axis and/or the Y-axis are enabled by maintaining a space that allows mechanical play between the ring and the deflection coils.

A deflection apparatus, embodying an aspect of the invention, includes a cathode ray tube having an evacuated glass envelope. A display screen is disposed at one end of the envelope and an electron gun assembly is disposed at a second end of the envelope. The electron gun assembly produces a plurality of electron beams that form beam spots at electron beam landing locations on the screen. A deflection yoke is mounted on a neck of the cathode ray tube. The deflection yoke includes a deflection winding for producing a deflection field between a beam entrance section and a beam exit section of the yoke to vary the beam landing location upon deflection. A core made of a magnetic material includes a first core portion and a second core portion that are magnetically coupled to each other and to the deflection winding, such that the position of one of the first and second core portions is adjustable with respect to the other one in a manner to vary the deflection field so as to correct for convergence error.

Figure 3:
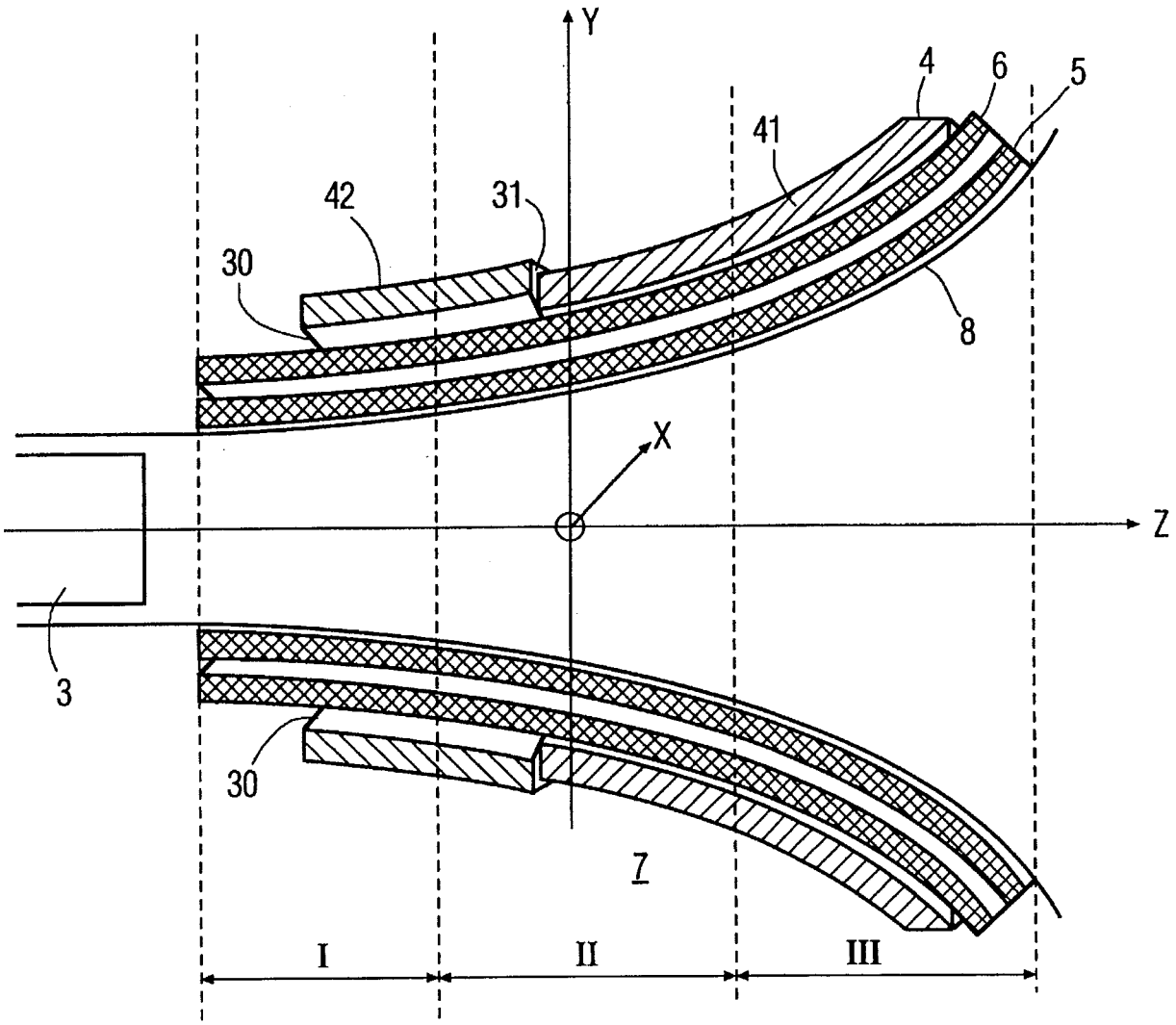
Figure 4:
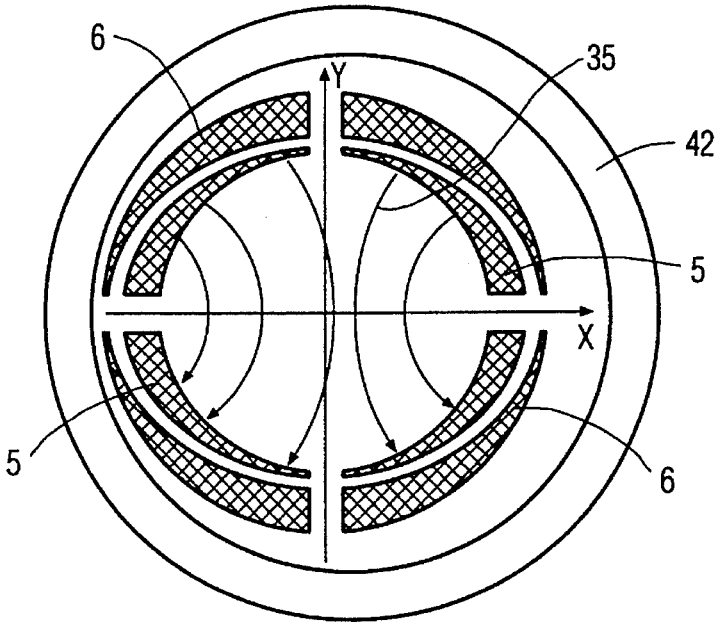
Figure 5:
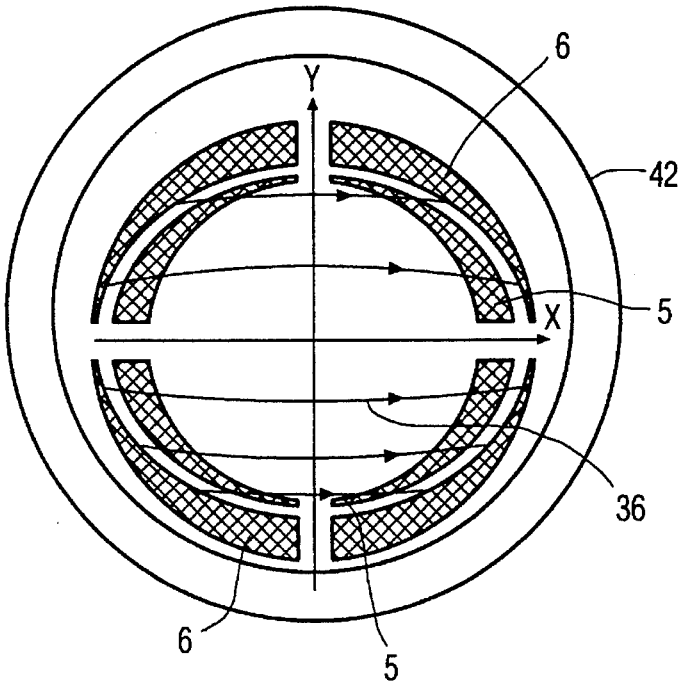

FIG. 3 is a section along a longitudinal axis of a CRT with a deflection yoke, embodying an aspect of the invention; and FIGS. 4 and 5 are two examples, respectively, of sectional views in a plane perpendicular to the longitudinal axis of the tube and yoke in the rear zone of the deflection yoke of FIG. 3, illustrating the effect of an auxiliary magnetic core, embodying an inventive feature, on the deflection field flux lines.

Figure 1:
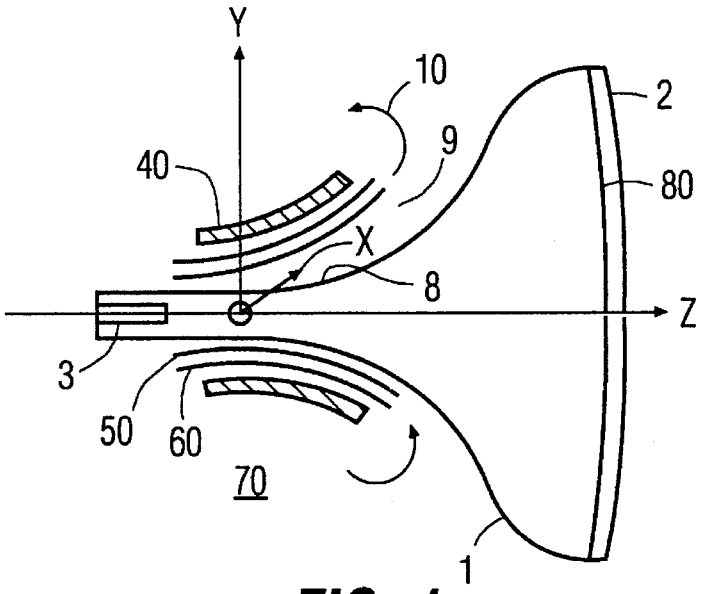
FIG. 1 PRIOR ART
FIG. 1 illustrates a cathode-ray tube with a prior art deflection yoke.

FIG. 1 illustrates a cathode ray tube 1 having a display screen 2. An electron gun 3 produces three coplanar electron beams in the plane X-Z corresponding to the three primary colors red, green and blue. A prior art deflection yoke 70 includes a pair of horizontal deflection coils 50, a pair of vertical deflection coils 60 disposed between a neck 8 of the CRT and a magnetic core 40. Yoke 70 may be, for example, of the Saddle-Saddle type.

The steps of aligning deflection yoke 70 on the CRT's neck are as follows. The position of yoke 70 is translated along the Z-axis to obtain the incidence of the electron beams at the holes of a mask 80. This step ensures color purity. When so adjusted, the electron beams illuminate the proper phosphor strips of the corresponding colors that are placed on the inner section of the cathode ray tube screen.

By rotation about the Z-axis, the deflection yoke is orientated to make the major and minor axes of the image coincide with those of the tube screen. By rotation of the front end of deflection yoke 70 in the X-Z and Y-Z planes, or by translation in directions parallel to the X-axis or Y-axis, the deflection fields are aligned so that the three electron beams converge at the points referred to as 3 and 9 o'clock hour points, and at the points referred to as 6 and 12 o'clock points.

Figure 2:
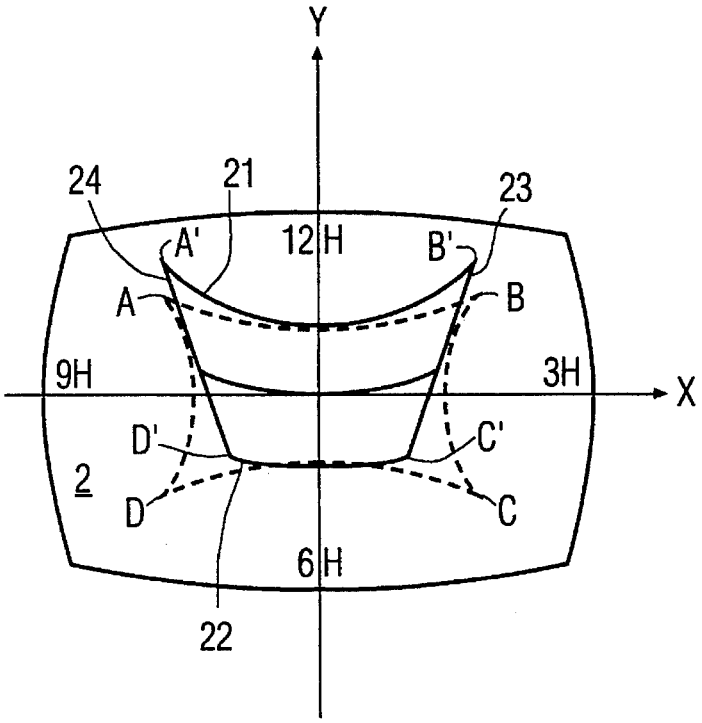
FIG. 2 illustrates an example of a geometrical distortion of the image formed on the screen obtained when the asymmetry adjustment of the axes of the deflection fields with respect to electronic beams is accomplished by a prior art method.

FIG. 2 illustrates an image having four corners A, B, C and D displayed on display screen 2 of FIG. 1. Similar symbols and numerals in FIGS. 1 and 2 indicate similar items or functions. Because of the flatness of the faceplate of screen 2, the image in FIG. 2 is pincushion distorted. Correction of pincushion distortion may be, conventionally, performed by suitable yoke field design or by dynamically varying a current having an appropriate waveform.

The aforementioned convergence field axes asymmetry adjustment may be performed by rotating the front of yoke 70 of FIG. 1 in the Y-Z plane, as shown by an arrow 10. Disadvantageously, the rotation may cause geometrical distortion of the image. For example, the image defined by corners A, B, C and D of FIG. 2 may appear distorted as defined by corners A', B', C' and D', respectively. Such distortion results in an upper edge 21 and in a lower edge 22 that are not symmetrical. Similarly, side edges 23 and 24 may give the image a trapezoidal type distortion. Likewise, rotation of the front of yoke 70 of FIG. 1 in the X-Z plane may cause asymmetry in side edges 23 and 24, in a manner not shown. Also, side edges 21 and 22 may give the image a trapezoidal type distortion.

The extent of such trapezoidal and symmetry geometry distortions may be significantly dependent on the extent of rotation in the X-Z and Y-Z planes of the front portion of deflection yoke 70 that is performed during the aforementioned asymmetry adjustment step. Such distortions are more pronounced when the screen of the CRT is flat and has a large radius of curvature such as used in high definition television receivers or work station displays. It may be desirable to reduce such geometry distortions.

FIG. 3 illustrates a cross section through a deflection yoke 7, embodying an aspect of the invention. Similar symbols and numerals in FIGS. 1–3 indicate similar items or functions. Yoke 7 is of the Saddle-Saddle type. Yoke 7 of FIG. 3 is mounted on a CRT having a diagonal of, for example, 40 centimeters. Yoke 7 includes a saddle shaped horizontal deflection coil 5 and a saddle shaped vertical deflection coil 6. A magnetic core 4 of FIG. 3 surrounds a substantial portion of coils 5 and 6. Core 4 made of a ferrite includes a front core portion 41 and a core extension or rear core portion 42, embodying an inventive feature. Front core portion 41 is firmly attached to coils 5 and 6 during adjustment of yoke 7 on the CRT.

During the convergence field axes asymmetry adjustment step, core portion 42 can be moved with respect to core portion 41 in a direction parallel to the X and/or Y axis. The ability to move core portion 42 is provided by the presence of a cavity 30 between an inner surface of portion 42 and an outer surface of vertical deflection coil 6. Core portion 41 surrounds a front zone III and part of a front portion of a middle zone II of yoke 7; whereas, core portion 42 surrounds the other part of zone II and a rear zone I. The effects of the deflection field in the rear, middle and front zones on the image have been explained before.

To prevent magnetic flux discontinuity between core portions 41 and 42, core portions 41 and 42 are kept in magnetic contact with each other along a common edge 31. In this way, core portions 41 and 42 have low magnetic reluctance therebetween. Rear core portion 42 is a ring having a length in the direction of the Z-axis that is approximately equal to one-half that of front core portion 41 or approximately one-third of deflection yoke 7. The ring shape of core portion 42 provides ease in manufacturing and is facilitated by having saddle coils 5 and 6 approximately cylindrical in the zones in which they are surrounded by core portion 42.

FIGS. 4 and 5 illustrate the effect of displacement of core portion 42 of FIG. 3 on the deflection field within core portion 42. Similar symbols and numerals of FIGS. 1–3, 4 and 5 indicate similar items or functions. A horizontal displacement of core portion 42 of FIG. 4 in a direction parallel to the X-axis has only little effect on the magnetic flux lines of the vertical deflection field produced by coil 6. Such horizontal displacement mainly affects flux lines 35 of the horizontal deflection field produced by coil 5. In the left side of FIG. 4 where coil 5 is closer to core portion 42, the horizontal deflection field is increased. In contrast, in the right side, where coil 5 is remote from core portion 42, the horizontal deflection field is decreased. Similarly, a vertical displacement of core portion 42 of FIG. 5 in a direction parallel to the Y-axis has only little effect on magnetic flux lines which are produced by coil 5; whereas, the main effect is on flux lines 36 produced by coil 6.

Aligning of deflection yoke 7 of FIG. 3 on the neck of the CRT includes the following steps. Yoke 7 is adjusted to the appropriate Z-axis location for providing color purity. Yoke 7 is then rotated about the Z-axis to make the image axes coincide with the minor and major axes of the display screen. Then the front portion of deflection yoke 7, including core portions 41 and 42, is rotated in the X-Z plane and/or in the Y-Z plane of yoke 7 and/or moved in parallel to the X-axis and/or the Y-axis for optimizing the image geometry. Alternatively, the image geometry optimizing step may be carried out in a known manner by adjustment of currents in a yoke control circuitry, not shown, or by the use of magnetic dipoles, not shown, arranged on the neck of the CRT, for example, at the back of yoke 7.

In the image geometry optimizing step, the objective is to reduce geometrical imbalance of the upper and lower edges and of the side edges. Likewise, any trapeze type distortion is also minimized. Then, the convergence field axes asymmetry adjustment step, described below, is carried out after the position of the front portion of the deflection yoke including the deflection coils is adjusted and does not change in the asymmetry adjustment step.

In the convergence field axes asymmetry adjustment step that provides convergence adjustment, the position of core portion 42 of FIG. 4 is adjusted in the direction of the X-axis to correct for convergence error so as to maintain equal separation between vertical red and blue lines at 3 and 9 o'clock hour points on the CRT screen and in the same sense, as explained before. Similarly, the position of core portion 42 of FIG. 5 is adjusted in the direction of the Y-axis to correct for convergence errors so as to maintain equal separation at the 6 o'clock hour point on the CRT screen and that at the 12 o'clock hour point and in the same sense, as explained before. After the final position of core portion 42 of FIG. 3 is determined, core portion 42 may be permanently attached to core portion 41 by, for example, applying adhesive material between them.

In accordance with an inventive feature, optimizing the image geometry is performed separately from the asymmetry adjustment step. The asymmetry adjustment step is carried out after the front part of deflection yoke 7 and the deflection coils are at fixed positions that do not change. In this way, advantageously, the adjustment of the fields in the asymmetry adjustment step does not significantly affect the image geometry. As indicated before, geometry distortion is adjusted in the aforementioned image geometry optimizing step by rotating yoke 7.

Moveable core portion 42 of magnetic core 4 is located at the rear half of deflection yoke 7 along the Z-axis so as to affect mostly the convergence of the electron beams and least the geometrical characteristic determined by the front part of deflection yoke 7. The sensitivity of core portion 42 with respect to field asymmetry adjustment can be changed by separating the action of core portion 42 on the horizontal or vertical deflection fields. For this purpose, it is possible to use instead of a core portion 42, a core portion having two core parts moveable with respect to one another and having a ring shape of different thicknesses. The effect of the ring on the deflection field increases with its thickness.

What is claimed is:

1. An apparatus, comprising;

a cathode ray tube having a neck and an electron gun assembly disposed in said neck for producing a plurality of electron beams that form beam spots at electron beam landing locations on said tube;

a deflection yoke mounted on said neck of said cathode ray tube and including a deflection winding and a magnetic core for producing a deflection field between a beam entrance section and a beam exit section of said yoke to vary the beam landing locations upon deflection; and said core having first and second core portions magnetically coupled to each other and to said deflection winding, one of said core portions being adjustable on said yoke in a direction perpendicular to a Z-axis of said tube, relative to a position of the other one of said core portions on said yoke, for modifying said deflection field to correct for convergence error of said beam spot landing locations.

2. An apparatus according to claim 1, wherein said first core portion and said yoke are adjusted into a position on said tube to reduce a geometry distortion of said field and said second core portion is adjustable with respect to said position of said first core portion and said yoke to correct said convergence error, said second core portion having a substantially smaller effect on said geometry distortion than said first core portion.

3. An apparatus according to claim 2, wherein said second core portion is located closer to said gun assembly than said first core portion.

4. An apparatus, comprising:

a cathode ray tube having a neck and an electron gun assembly disposed in said neck for producing a plurality of electron beams that form beam spots at electron beam landing locations on said tube;

a deflection yoke mounted on said neck of said cathode ray tube and including a deflection winding and a magnetic core for producing a deflection field between a beam entrance section and a beam exit section of said yoke to vary said beam landing locations upon deflection: and said core having first and second core portions magnetically coupled to each other and to said deflection winding, one of said core portions being adjustable during a convergence error correction in a direction perpendicular to a Z-axis of said tube.

5. An apparatus according to claim 2 wherein said second core portion has a ring shape.

6. An apparatus according to claim 1 wherein said first and second core portions are magnetically coupled to each other in a manner to maintain low magnetic reluctance therebetween.

7. An apparatus according to claim 2 wherein the position of said core is adjusted to adjust asymmetry of the axes of said deflection field with respect to said beams.

8. An apparatus, comprising:

a cathode ray tube including an evacuated glass envelope, a display screen disposed at one end of said envelope and an electron gun assembly disposed at a second end of said envelope, said electron gun assembly producing an electron beam that forms a beam spot at electron beam landing locations on said screen;

a deflection yoke mounted on a neck of said cathode ray tube including, a deflection winding for producing a deflection field between a beam entrance section and a beam exit section of said yoke to vary the beam landing location upon deflection; and a core made of a magnetic material including a first core portion and a core extension portion that are magnetically coupled to said deflection winding and to each other in a manner to maintain low magnetic reluctance therebetween, such that the position of one of said first core portion and said core extension portion is adjustable with respect to the other one in a direction perpendicular to a Z-axis of said tube in a manner to vary said deflection field so as to correct for beam landing location error.

9. An apparatus, comprising:

a cathode ray tube including an evacuated glass envelope, a display screen disposed at one end of said envelope and an electron gun assembly disposed at a second end of said envelope, said electron gun assembly producing an electron beam that forms a beam spot at electron beam landing locations on said screen;

a deflection yoke mounted on a neck of said cathode ray tube including, horizontal and vertical deflection windings for producing a deflection field between a beam entrance section and a beam exit section of said yoke to vary the beam landing location upon deflection; and a core made of a magnetic material including first and second core portions surrounding a portion of said deflection windings and transversely adjustable with respect to said deflection windings, wherein one of the first and second core portions is in a direction perpendicular to a Z-axis of said tube.

* * * * *